US008079225B2

(12) United States Patent
Bauer et al.

(10) Patent No.: US 8,079,225 B2
(45) Date of Patent: Dec. 20, 2011

(54) REFRIGERATING APPLIANCE PROVIDED WITH AN OLED DISPLAY

(75) Inventors: Peter Bauer, München (DE); Fritz Hägele, Herbrechtingen (DE); Erich Hell, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1376 days.

(21) Appl. No.: 10/570,179

(22) PCT Filed: Aug. 30, 2004

(86) PCT No.: PCT/EP2004/009652

§ 371 (c)(1),
(2), (4) Date: Oct. 27, 2006

(87) PCT Pub. No.: WO2005/024324

PCT Pub. Date: Mar. 17, 2005

(65) Prior Publication Data

US 2007/0097042 A1 May 3, 2007

(30) Foreign Application Priority Data

Aug. 29, 2003 (DE) ..... 103 39 941

(51) Int. Cl.
*F25B 49/00* (2006.01)
*G05D 23/00* (2006.01)
*H01J 1/62* (2006.01)

(52) U.S. Cl. ..... 62/126; 62/127; 236/94; 313/504; 345/60; 345/65; 345/82

(58) Field of Classification Search ..... 62/126, 62/127, 129; 165/11.1; 236/94; 313/504; 345/55, 60, 65, 82

See application file for complete search history.

(56) References Cited

U.S. PATENT DOCUMENTS

| | | | | |
|---|---|---|---|---|
| 5,965,907 | A * | 10/1999 | Huang et al. | 257/89 |
| 6,337,492 | B1 | 1/2002 | Jones et al. | |
| 6,393,848 | B2 * | 5/2002 | Roh et al. | 62/126 |
| 6,397,606 | B1 * | 6/2002 | Roh et al. | 62/126 |
| 6,430,946 | B2 * | 8/2002 | Roh et al. | 62/125 |
| 6,483,695 | B1 * | 11/2002 | Hartstein | 361/679.09 |
| 6,656,611 | B2 * | 12/2003 | Tai et al. | 428/690 |
| 2002/0014082 | A1 * | 2/2002 | Hiraoka et al. | 62/127 |
| 2002/0112488 | A1 * | 8/2002 | Daum et al. | 62/125 |
| 2002/0118320 | A1 * | 8/2002 | Bayrle et al. | 349/73 |
| 2002/0149320 | A1 | 10/2002 | Maruyama et al. | |
| 2002/0153243 | A1 | 10/2002 | Forrest et al. | |
| 2003/0010043 | A1 * | 1/2003 | Ferragut, II | 62/126 |
| 2003/0017360 | A1 | 1/2003 | Tai et al. | |
| 2003/0062519 | A1 * | 4/2003 | Yamazaki et al. | 257/40 |

(Continued)

FOREIGN PATENT DOCUMENTS

DE 100 09 204 8/2001

(Continued)

OTHER PUBLICATIONS

International Search Report PCT/EP2004/009652.

*Primary Examiner* — Marc Norman

(74) *Attorney, Agent, or Firm* — James E. Howard; Andre Pallapies

(57) ABSTRACT

A refrigerating appliance provided with a display including at least one organic light-emitting diode (OLED). The display can include a plurality of individual displays which are respectively provided with at least one OLED, and are superimposed in a sandwich-type arrangement and can be of different colors.

15 Claims, 5 Drawing Sheets

U.S. PATENT DOCUMENTS

| | | | | |
|---|---|---|---|---|
| 2003/0134488 | A1* | 7/2003 | Yamazaki et al. | 438/455 |
| 2003/0180614 | A1 | 9/2003 | Saito et al. | |
| 2003/0193796 | A1* | 10/2003 | Heeks et al. | 362/84 |
| 2004/0169464 | A1 | 9/2004 | Birnstock et al. | |
| 2004/0180457 | A1 | 9/2004 | Birnstosk et al. | |
| 2004/0251818 | A1* | 12/2004 | Duggal et al. | 313/504 |
| 2007/0128765 | A1* | 6/2007 | Auch et al. | 438/105 |

FOREIGN PATENT DOCUMENTS

| | | |
|---|---|---|
| DE | 101 33 686 | 1/2003 |
| EP | 1 253 643 | 10/2002 |
| JP | 2001-100641 A | 4/2001 |
| JP | 2002-313571 | 10/2002 |
| WO | WO 03/061027 | 7/2003 |

* cited by examiner

REFRIGERATING APPLIANCE PROVIDED WITH AN OLED DISPLAY

This application is the U.S. national phase of International Application No. PCT/EP2004/009652 filed Aug. 30, 2004 which designated the U.S. and claims priority to German Patent Application No. 10339941.0 filed Aug. 29, 2003, the entire contents of each of which are hereby incorporated by reference.

The present invention relates to a refrigerating appliance with a display and a display which can preferably be used for refrigerating appliances.

In refrigerating appliances there is generally a desire to display information on the type of appliance as well as operating information on a display panel or display for the user.

Information which stays the same, such as for example the type of refrigerating appliance can be reproduced on an adhesive label or name plate for example. However, changing information such as the temperature in the interior of the refrigerating appliance cannot be displayed in this way.

Consequently, present-day refrigerating appliances such as refrigerators or freezers frequently have LED (light emitting diode) displays on which characters are imaged in a seven-segment representation. This has the disadvantage however that only a very limited selection of characters can be represented such as numbers and letters which can be reproduced in the seven-segment representation. Complexly configured characters such as company logos or similar which must be composed of arbitrarily definable picture elements thus cannot be represented. A feasible arrangement of LEDs in matrices composed of individual image points, however, is very bulky and in addition, very expensive. Randomly definable forms of characters can be achieved using liquid-crystal displays (LCD=Liquid Crystal Display) but these have the disadvantage that they are not themselves emitting and thus can only be read easily and recognised under particularly favourable ambient light conditions. In most cases, this makes back lighting necessary. In addition, LCD displays can only be viewed from a restricted range of viewing angles.

It was thus the object of the present invention to provide a refrigerating appliance with a display, or a display especially for use for a refrigerating appliance, on which self-illuminating randomly definable forms of picture elements can be represented.

Accordingly, a refrigerating appliance is provided with a display wherein the display comprises at least one organic light-emitting diode (OLED).

An advantage of this display is that randomly definable forms of picture elements can be produced thereon. In addition, it is self-illuminating so that background lighting is not required. The display can be viewed from a wide range of viewing angles. Thus, the display can be arranged on the refrigerating appliance at various positions. It is not necessary for the display to be located directly at eye level of the user of the refrigerating appliance. In addition, the display can be executed as curved, for example, following a curved housing contour of the refrigerating appliance since OLEDs can also be applied to curved surfaces. Since OLED displays have a very high luminous intensity, if the display is disposed in an interior compartment of the refrigerating appliance, this can also be used for interior illumination for the refrigerating appliance. Low voltage is sufficient for the power supply of OLEDs. In addition, OLEDs use little energy.

The display usually comprises a plurality of OLEDs, each forming picture elements of the display where respectively one OLED preferably forms one image point of the display. Thus, characters and symbols having arbitrary outlines can be represented on the display. The picture elements or OLEDs are especially preferably arranged in a matrix form.

The organic light-emitting diodes (OLEDs) generally consist of a substrate, an electrode, one or a plurality of organic layers and a counter-electrode. Said components are generally constructed in the form of thin layers which are stacked one upon the other in "sandwich structure". An example of an OLED structural element for use for a display device is described in DE 102 32 937 A1.

The substrate is generally transparent, glass or quartz being particularly preferred. Plastic films or glass/plastic laminates can be used as substrates. Plastics such as polyethylene terephthalate (PET) or polyethylene naphthalate (PEN) can be used.

An electrically conducting transparent layer is usually located on the substrate as an electrode. This preferably consists of a transparent, electrically conducting oxide material such as indium tin oxide (ITO). Alternatively, other transparent conducting materials, such as thin metal films can also be used. The transparent conducting electrode layer is preferably used as an anode.

One or a plurality of layers of organic materials are usually located on the electrode layer, but at least one electroluminescent, i.e. light-emitting layer. Each organic layer can be configured so that it executes one or a plurality of functions such as hole injection, hole transport, electron injection, electron transport and/or light emission (electroluminescence). However, it can also comprise a single intermediate layer. The organic layers can consist of polymers, oligomers or small functional molecules. They can be formed, for example, by thermal vaporisation or by wet-chemical methods from a solution. In order to impart a structure to the at least one organic layer, this can be applied for example by means of various printing techniques.

Finally, one or a plurality of layers of conducting materials, preferably metals or metal alloys are located on the organic layers as a counter-electrode. In this case, the counter-electrode usually serves as the cathode. The counter-electrode is preferably constructed of two layers: an underlayer which is formed of a metal having a low work function such as Ca, Mg, Ba or Li and a covering layer made of a metal which is more stable to air and having a high work function such as Ag or Al.

The thickness of each layer comprising the OLED can generally lie between about 10 nanometers and 20 micron and is usually in the range between 50 nanometers and 20 micron.

During operation, a voltage is applied between the electrode and the counter-electrode, charge carriers are injected into the organic layers, recombination takes place and some of the recombination energy leaves the OLED as photons. The photons pass through the transparent electrode layer and the transparent substrate and are visible as emitted light.

The OLEDs are preferably protected by encapsulation since both the organic layers and also some electrode materials react sensitively to oxidation by oxygen and moisture.

Neighbouring OLEDs in the display must be suitably delimited from one another in order to be able to function and be able to be controlled as individual picture elements such as image points, for example. For this purpose the material layers from which the OLEDs are constructed are preferably constructed in the form of strips which intersect at the picture elements of the display in a plan view of the display. A point of intersection preferably forms an image point or an independent OLED of the display. In this case, the electrode layers such as the anode layers and cathode layers as well as the electroluminescent layers can be constructed in intersecting strips, where the points of intersection form a matrix. A display with electrodes constructed in strips is disclosed in DE 102 32 937 A1. In addition, the electroluminescent layers of neighbouring OLEDs can be delimited from one another by an insulating material. Used for this purpose in DE 102 32 937 A1 is an insulating polysiloxane structure in which windows are formed in which the electroluminescent layers of the OLEDs are located. These structures are likewise described in DE 101 33 686 A1, DE 101 33 685 A1 and in DE 101 33 684 A1.

Furthermore, the display preferably comprises a control device which controls the picture elements in the matrix separately from one another. This makes it possible to represent characters or symbols on the display to display information. In this case, the control can take place passively or actively. In the case of passive control, for each picture element to be controlled current is applied to the corresponding rows and columns of the strip-shaped electrode layers. DE 101 33 685 A1 discloses, for example, a passive-matrix driven display. In addition to the passive control, it is also possible to actively control the picture elements. In this type of actively addressed display, two transistors are usually integrated in each picture element. One of the transistors acts as a switching element for image point selection and the other as an analogue amplifier. The transistors, for example, comprise thin film transistors. An example of an addressed OLED display is described in DE 100 09 204 A1.

The display can comprise various types of OLEDs which differ in their emitted colour spectra. For this purpose the different types of OLEDs usually comprise electroluminescent materials which emit light colours of different colour spectra. Thus, for example displays with different-coloured image points can be formed. A coloured display composed of image points emitting blue, green and red light is described in DE 101 33 684 A1.

In the refrigerating appliance according to the invention, the display is preferably divided into a plurality of fields where each field comprises a plurality of OLEDs preferably arranged in a matrix form. At least two of the fields differ in respect of the emitted colour spectra of their electroluminescent layers. For example, the display can have two fields wherein in one of the fields the picture elements or OLEDs emit blue light and the picture elements or OLEDs of the other field emit red light. Other colours such as green or yellow can also be used.

A wide range of information can be displayed on the display of the refrigerating appliance, such as for example, the interior temperature of the refrigerating appliance, the time, operating information such as quick freeze or similar, trademark logos, model designations of the refrigerating appliance, article numbers etc. This information can also be displayed in different colours to make it more easily distinguishable for the user of the refrigerating appliance.

Within the scope of the present invention the display can form part of the control panel. In this case, it can be used both for displaying information, by controlling individual picture elements to represent characters. However, the display can also be used for illumination or back lighting of the control panel. In this case, all the picture elements of the display are generally controlled.

The display can also be disposed in the interior of the refrigerating appliance. An advantage of this is that in addition to displaying information, the display can also be used for illuminating the respective interior of the refrigerating appliance.

The present invention additionally comprises a display formed of a plurality of individual displays arranged one above the other in a sandwich arrangement. Each of the individual displays comprises at least one OLED, usually however a plurality of OLEDs preferably arranged in matrix form, each forming picture elements, preferably image points of the individual display. The OLEDs or picture elements of the various individual displays can be arranged such that, when the display is viewed from above, they do not, at least partially or completely overlap. This type of display has the advantage that information in the form of characters can be displayed on one of the individual displays, preferably the uppermost whereas at the same time, a display located thereunder can form background illumination. The characters or the background illumination are preferably in different colours or colour spectra. In addition, the display also has the advantage that light colours of OLEDs arranged one above the other can be mixed. Thus, contrasts can be intensified for example. In addition, a coloured display can be created by arranging three individual displays with red, blue and green picture elements one above the other so that all the light colours can be represented.

Further embodiments and advantages of the present invention are explained hereinafter with reference to embodiments of the present invention. In the figures.

Figure 1:
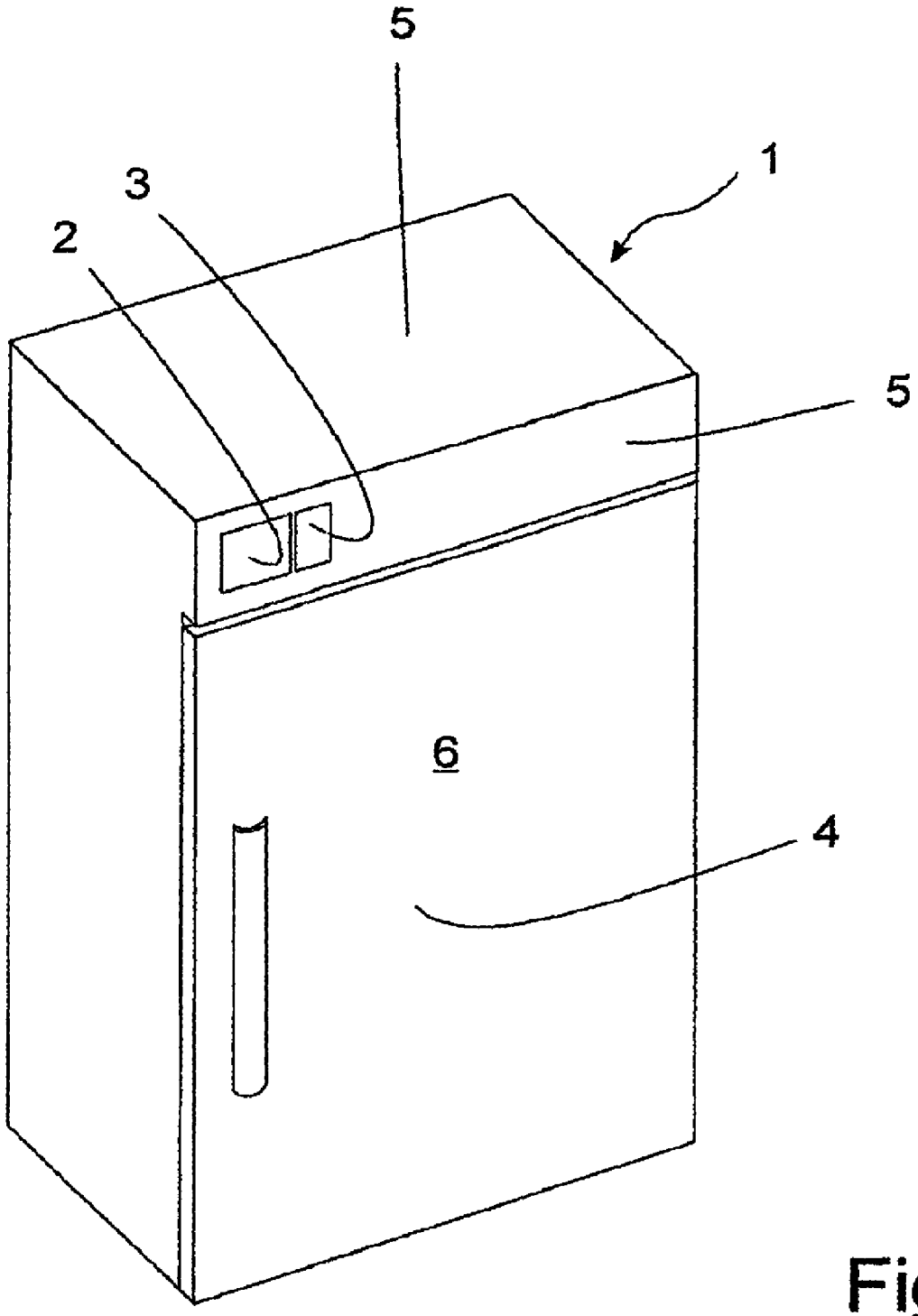
FIG. 1 is a perspective view of a refrigerating appliance 1 according to the present invention with a display 2.

FIG. 1 shows a refrigerating appliance, comprising a refrigerator 1. This has a display 2 and a control panel 3. The display 2 and the control panel 3 are mounted above an appliance door 4 on the front of the housing 5 of the refrigerating appliance 1. The display 2 and the control panel 3 can also be located on the appliance door 4 on the door outer wall 6 or in an interior of the refrigerating appliance 1. The latter is preferably combined with an at least partly transparent appliance door 4 so that the display can be read off from outside the refrigerating appliance 1 without opening the appliance door 4.

Figure 2:
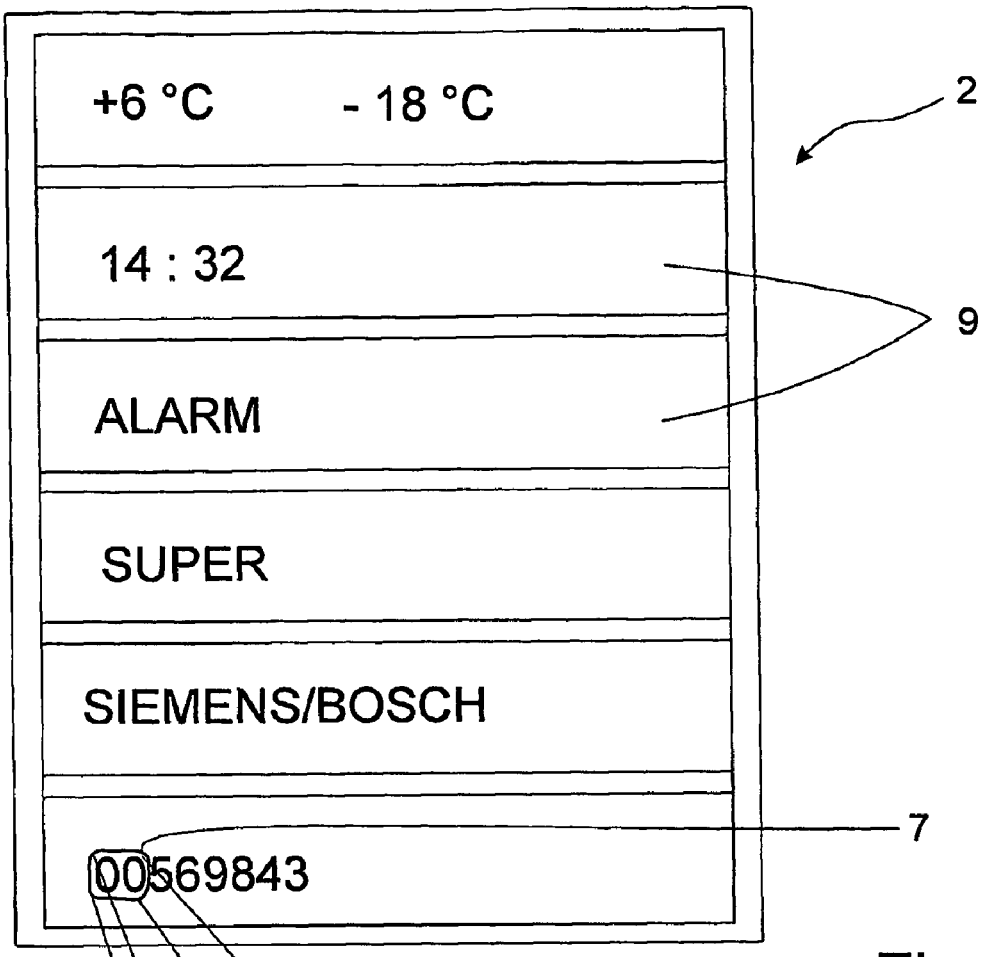
FIG. 2 is a plan view of the display 2 from FIG. 1 in an enlarged representation.

FIG. 2 shows a plan view of the display 2 from FIG. 1. The display 2 is divided into a plurality of fields 9. Information such as temperatures in the interior of the refrigerating appliance 1, the time, operating information as well as trademark logos or product numbers can be represented in the form of characters and symbols in each of the fields 9.

Figure 3:
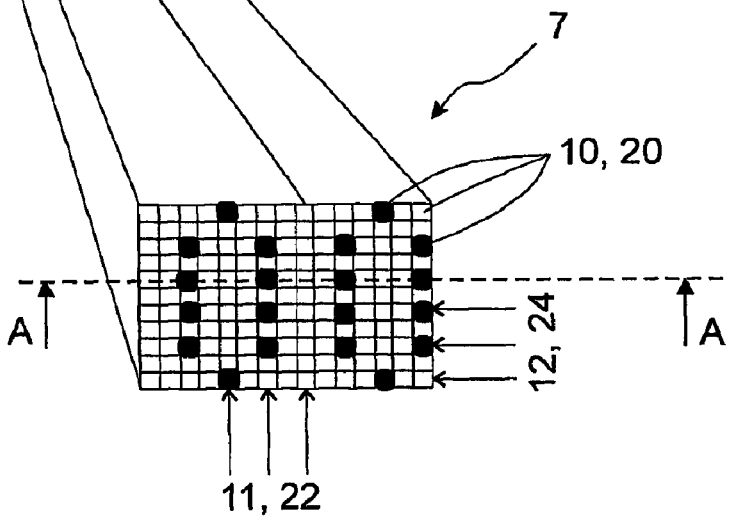
FIG. 3 is a section 7 of the display 2 from FIG. 2.

For displaying this information, each field 9 of the display 2 comprises a plurality of organic light-emitting diodes (OLEDs) 20 as shown in FIG. 3 for an enlarged section 7. Each OLED 20 forms a picture element 10 in the form of an image point or a pixel 10 of the display 2. In this case, the OLEDs are arranged in matrix form in columns 11 and rows 12. The display section 7 shows the character "00" of a product number which is displayed in the lowest field 9 of the display 2. The characters "00" are imaged on the display 2 by applying a voltage to corresponding OLEDs 20, whereby the OLEDs are made to light up.

Figure 4:
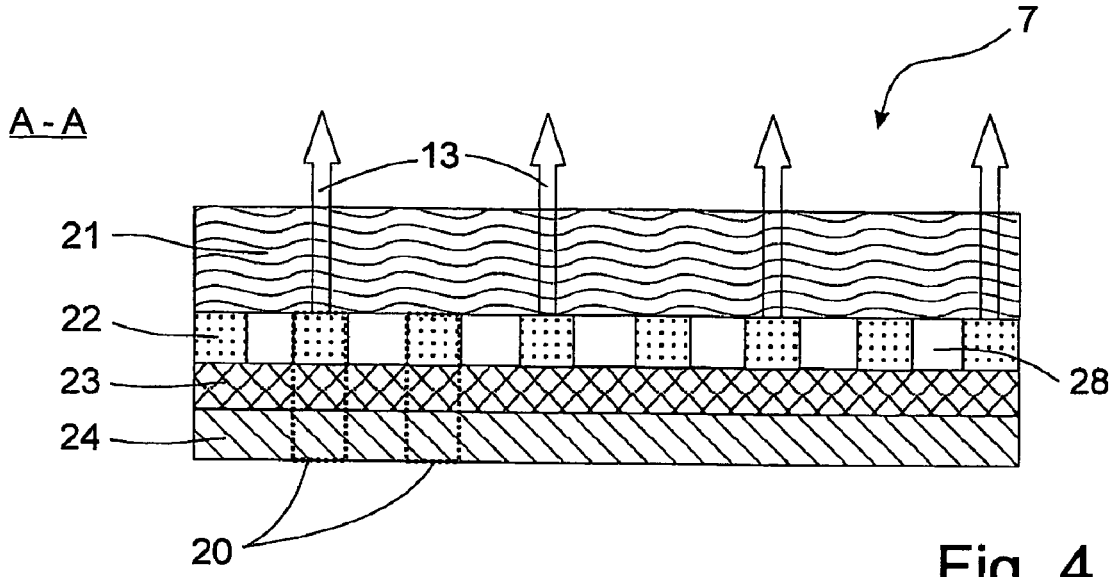
FIG. 4 is a cross-section through the display section 7 from FIG. 3 along the line A-A.
Figure 5:
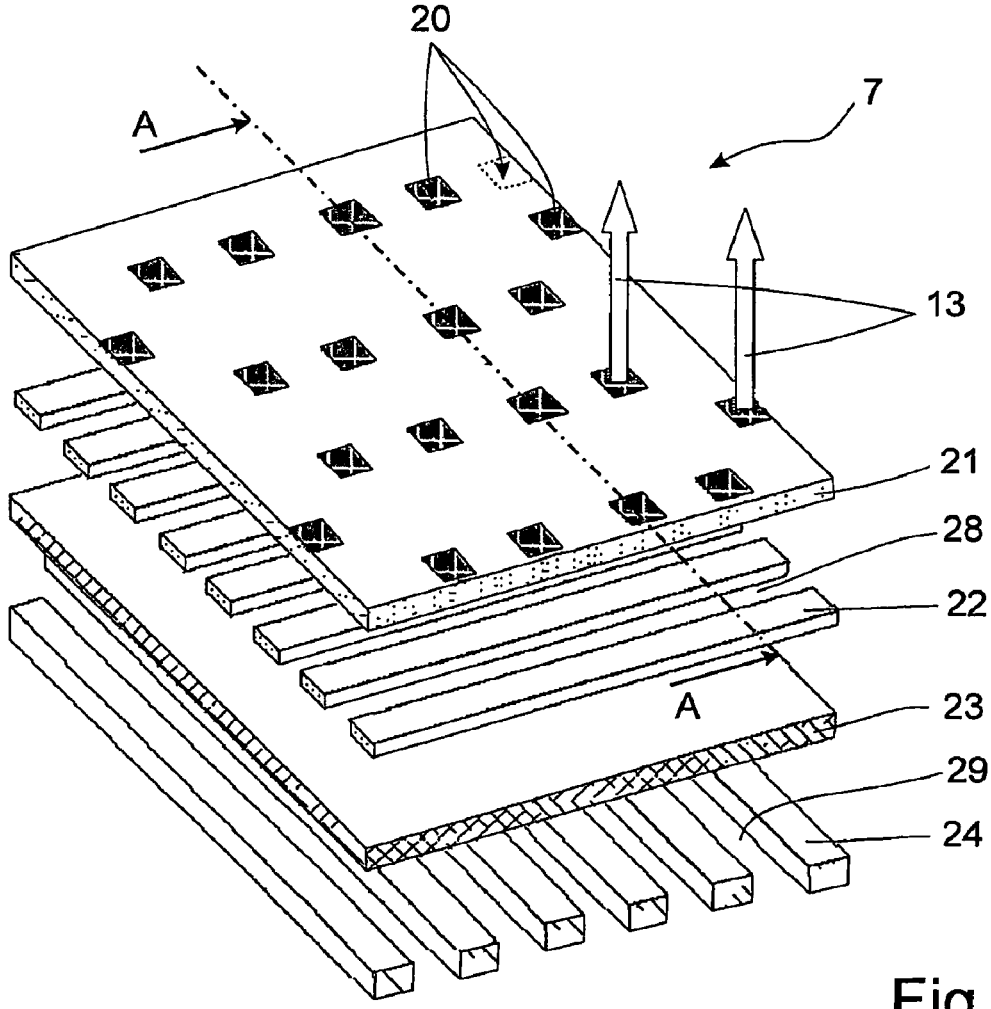
FIG. 5 is an exploded view of the display section 7 from FIGS. 3 and 4.

FIGS. 4 and 5 show a first possible structure of the display 2. In this case, FIG. 4 shows a cross-section through the display section 7 from FIG. 3 and specifically along the line A-A. The same display section 7 is shown in an exploded view in FIG. 5. According to FIGS. 4 and 5, the display 2 first comprises a glass or plastic plate 21 which forms the surface of the display 2 and serves as substrate for the OLEDs 20. This is followed by electrode strips 22 which serve as anodes for the OLEDs 20. The electrode strips 22 consist of indium tin oxide (ITO). They are arranged parallel to one another and spaced apart from one another. They correspond to the columns 11 in FIG. 3. Adjoining this is an emission layer 23 comprising an electroluminescent material. The next layer comprises counter-electrode strips 24 which corresponds to the rows 12 in FIG. 3. They serve as cathodes of the OLEDs 20. The cathode strips 24 generally consist of one or more layers of metals. The cathode strips 24 are preferably constructed from two layers, which is not shown however: a first layer constructed from a metal having a low work function, such as Ca, Mg, Ba or Li and a second layer which covers the first layer towards the surroundings, comprising a metal which is more stable with respect to air and has a high work function such as Ag or Al. Apart from the emission layer 23, further layers can also be arranged between the anode strip 22 and the cathode strip 24, for example, organic layers which execute one or more of the following functions: hole injection, hole transport, electron injection, electron transport or other electroluminescent, i.e. light-emitting layers. The intermediate spaces 28 between the anode strips 22 and the intermediate spaces 29 between the cathode strips 24 can, for example, be implemented using a separating material which is not shown however.

The display 2 comprises a passive matrix OLED display. In order to produce the characters "00" in the display section 7, a voltage is applied to the anode strips 22 and cathode strips 24 pertaining to the corresponding OLEDs with the aid of a control device which is not shown. As a result, charge carriers are injected into the emission layer 23 of the OLEDs 20, recombination takes place and some of the recombination energy leaves the OLEDs as photons. The photons pass through the transparent anode strips 22 and the glass plate 21 and are visible as emitted light 13. Individual characters and logos can be displayed in the fields 9 of the display 2 from FIG. 2, as described previously by controlling the desired OLEDs 20 of the display. However, it is also possible to control all the image points 10. In this way, a single or several fields 9 of the display 2 can be used, for example, to illuminate an interior of the refrigerating appliance 1 if the display 2 is located in an interior of a refrigerating appliance unlike the diagram in FIG. 1.

Figure 6:
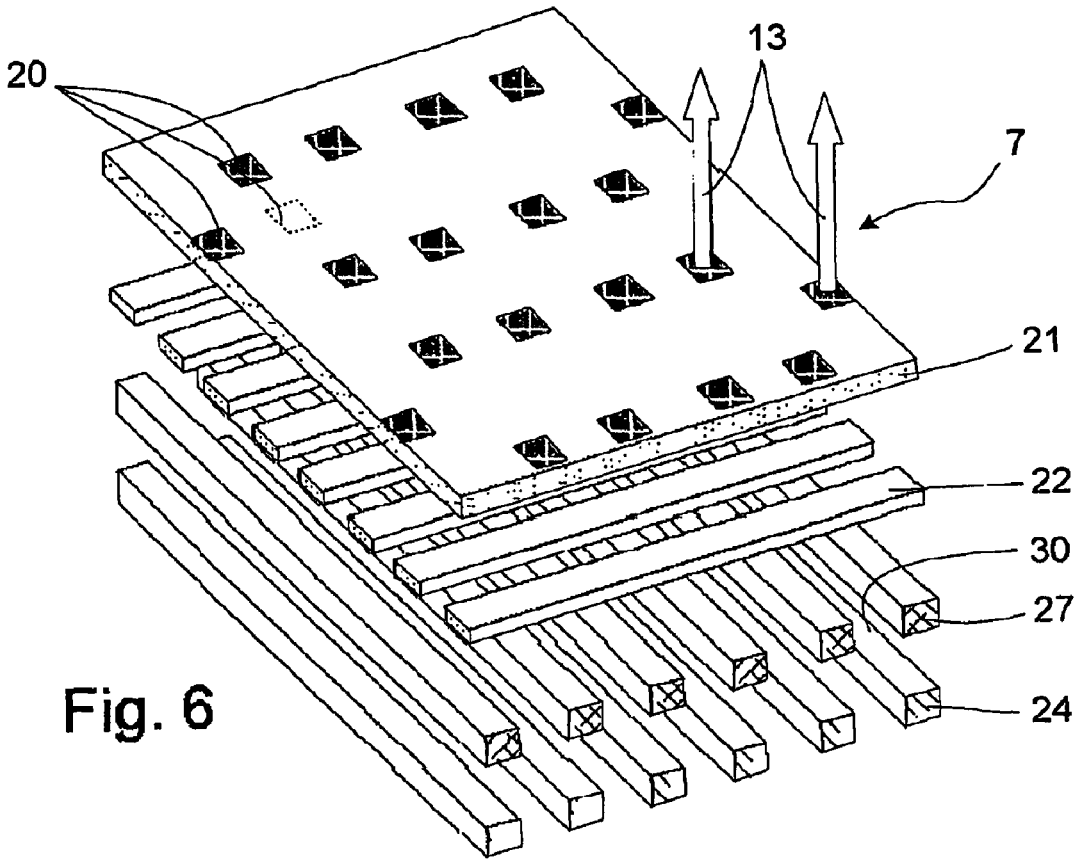
FIG. 6 is an exploded view of an alternative structure of the display 2 from FIGS. 2 and 3.

FIG. 6 shows another possible second embodiment of a structure of the display 2. The same display section 7 as in the preceding FIG. 5 is again shown. In contrast to the display 2 from FIG. 5, the display 2 from FIG. 6 comprises an emission layer constructed as emission strips 27. The emission strips 27 comprise an electroluminescent material and thus functionally correspond to the emission layer 23 of the display 2 from FIG. 5. The emission strips 27 have the same spatial alignment as the cathode strips 24. The intermediate spaces 30 between the emission strips 27 can be filled with a suitable separating material, such as an electrically insulating material which is not shown however.

Figure 7:
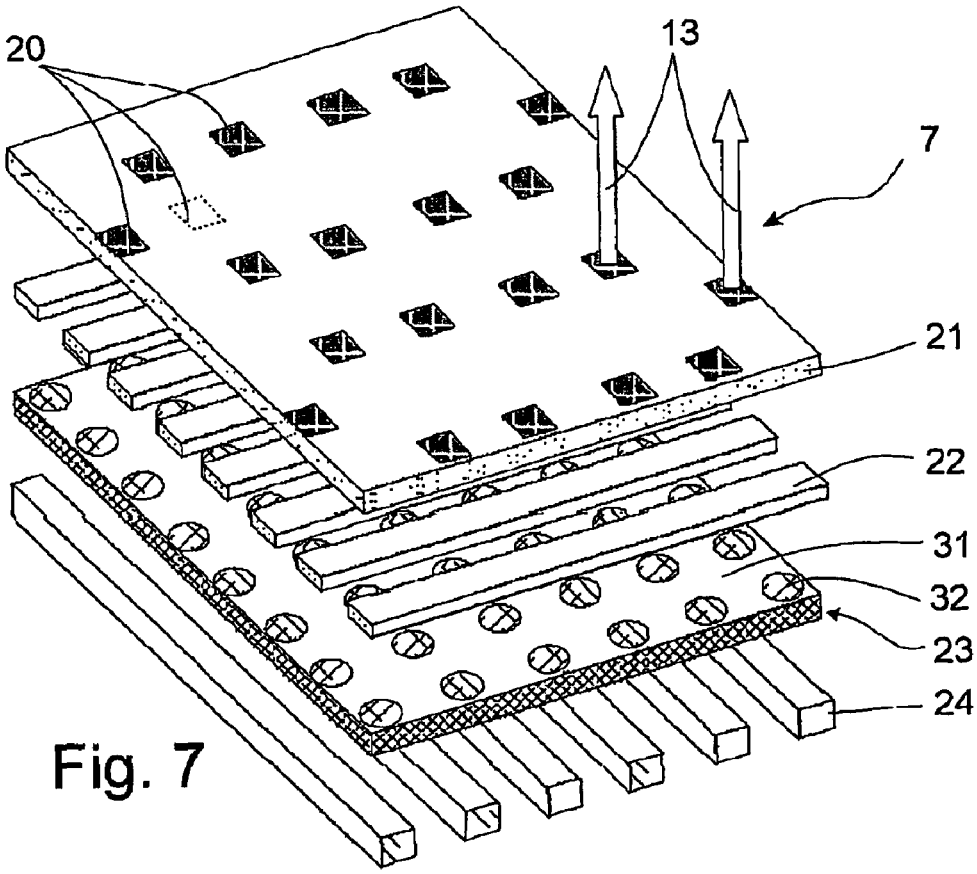
FIG. 7 is a further alternative structure of the display 2 from FIGS. 2 and 3.

FIG. 7 shows another third alternative embodiment of a possible structure of the display 2. The display section 7 from FIG. 2 is shown. In this structure the emission layer 23 comprises an insulating structure 31 in which windows 32 are formed. When the display 2 is viewed from above, these are located at the points of intersection of the anode strips 22 and the cathode strips 24. An electroluminescent material is located in the windows 32. Each window 32 with electroluminescent material corresponds to an OLED 20.

Electroluminescent materials which emit different colour spectra can be used for a display 2 according to FIGS. 2 to 7. Thus, characters can be represented with different colours on the display 2, for example. In the display 2 according to FIG. 2 the characters shown in the fields 9 can have different colours from one another. For example, the characters in the first field 9 can be displayed as blue, those in the second field 9 as green and those in the third field 9 as red etc. For this purpose the fields 9 must differ with regard to the electroluminescent materials comprising the OLEDs. It is also feasible to provide the OLEDs with different-coloured light-emitting materials within one field 9. This can be implemented simply in a display structure according to FIG. 7 by providing the windows 32 with different electroluminescent materials. In this way, a coloured display can be obtained, as is described for example in DE 101 33 684 A1.

Figure 8:
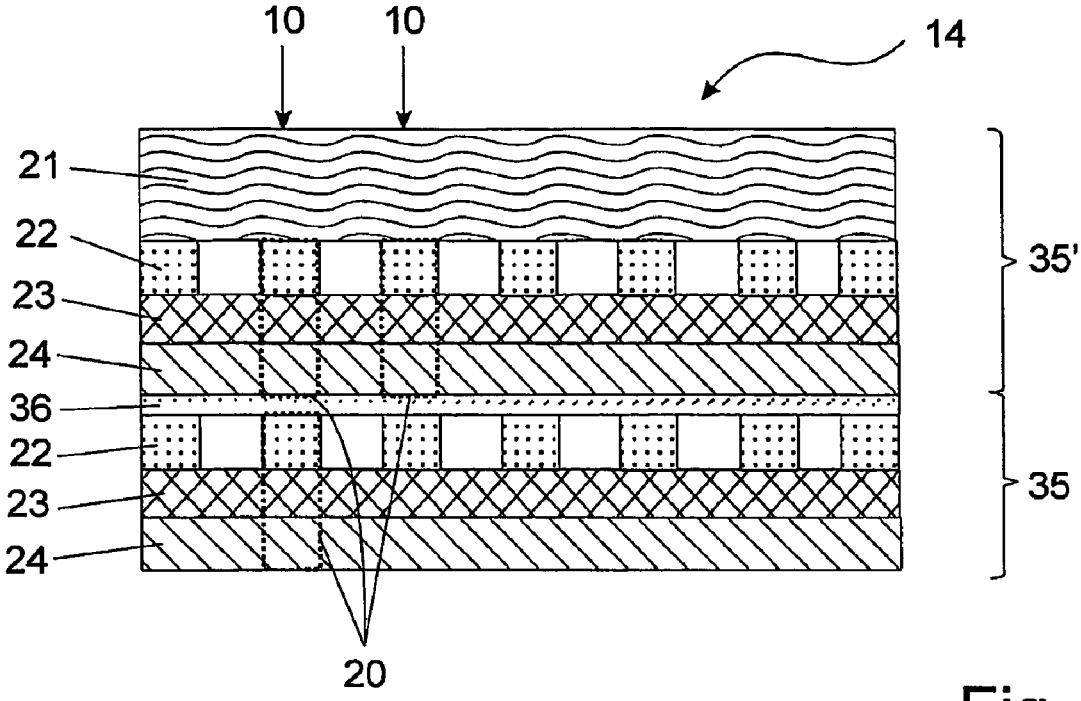
FIG. 8 is a cross-section through a display 14 formed from two individual displays 35.

FIG. 8 shows a display 14, formed from individual displays 35, 35' which are arranged one above the other in a sandwich structure. In the present embodiment the individual displays 35, 35' have the same structure as the display section 7 of the display 2 shown in FIGS. 4 and 5. Located between the individual displays 35, 35' is a transparent separating layer 36, for example, comprising an electrically insulating material. The separating layer 36 can, for example, comprise a glass plate. In the single display 35' the cathode strips 24 and the emission layer 23 are also transparent so that the emitted light of the lower single display 35 can pass through the upper single display 35'. OLEDs 20 of the various single displays 35, 35' arranged above one another overlap in a plan view of the display 14. They accordingly form a common image point 10 on the display 14. The display 14 formed of several single displays 35, 35' has the advantage that on the one hand, for example, characters and symbols can be displayed in one colour on the upper of the two single displays 35' whereas the single display 35 located thereunder forms background lighting in a different colour for the single display 35 located thereabove. In order to form the background lighting, either all the OLEDs 20 of the lower single display 35 are controlled or all the OLEDs 20 of the lower single display 35 apart from those located underneath the OLEDs 20 controlled in the single display located thereabove. The emission layers 23 of the single displays 35, 35' comprise electroluminescent materials which emit light of different colour spectra.

Unlike the design shown in FIG. 8, the single displays 35 of the display 14 can also have a structure as shown for the display section 7 of a display 2 in FIGS. 6 and 7. In addition, the OLEDs 20 of the single display 35 can also be arranged offset with respect to one another in a plan view of the display 14. As a result, each OLED 20 of the single display 35 can form an image point 10 on the display 14. In addition, three single displays whose OLEDs emit blue, green and red light can be arranged above one another, which is not shown. It is thereby possible to form a coloured display which can produce white light as well as all light colours.

Figure 9:
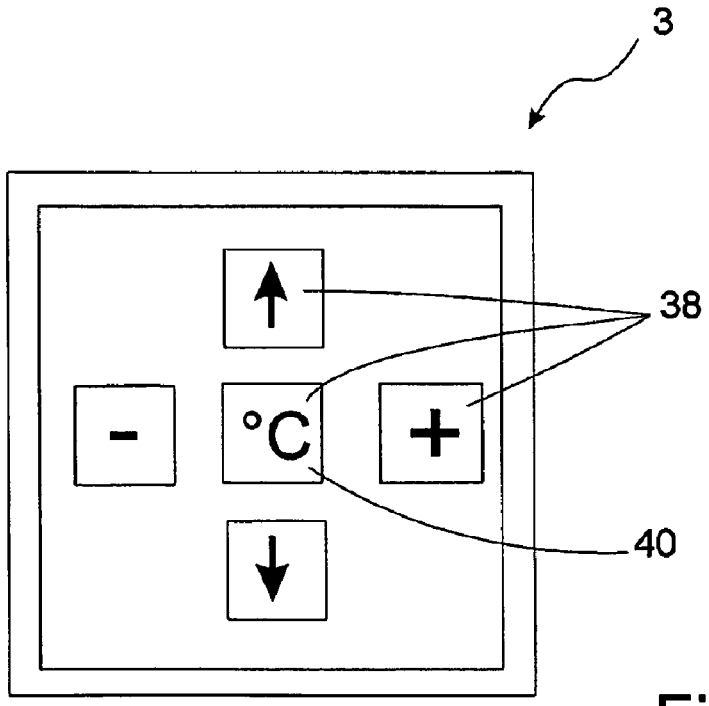
FIG. 9 is a plan view of the control panel 3 from FIG. 1.

FIG. 9 shows the control panel 3 from FIG. 1 in an enlarged view. Desired operating conditions such as interior temperatures for example for the refrigerating appliance 1, can be entered using this panel. For this purpose the control panel 3 has push-buttons 38. In the present embodiment of the control panel 3 the central push-button 38 has a display 40 on which changing information can be displayed, such as for example adjustable operating conditions of the refrigerating appliance, such as the interior temperature of the refrigerating appliance 1. The display 40 can be configured in the same way as one of the displays 2 or 14 described for the previous figures.

The invention claimed is:

1. A refrigerating appliance, comprising:

a housing defining a refrigerated compartment;

a door attached to the housing and closing the refrigerated compartment; and a display secured to at least one of the housing and the door;

wherein said display includes a plurality of organic light-emitting diodes (OLEDs) arranged in matrix form in columns and rows, and wherein the display comprises anodes in the form of electrode strips defining one of the columns and the rows with spacers therebetween, cathodes in the form of counter-electrode strips defining the other of the columns and the rows with spacers therebetween, an emission layer disposed between said anodes and said cathodes, and means for applying a voltage to the anodes and the cathodes to generate emitted light from selected portions of the display, wherein the emission layer comprises a plurality of emission strips having substantially the same spatial alignment including length and width as the counter-electrode strips.

2. The refrigerating appliance according to claim 1, wherein each of the OLEDs forms a picture element of said display.

3. The refrigerating appliance according to claim 2, including said picture elements or OLEDs are arranged in a matrix form.

4. The refrigerating appliance according to claim 1, including said display forming a portion of a control panel of the refrigerating appliance.

5. The refrigerating appliance according to claim 1, including said display arranged in the refrigerated compartment of the refrigerating appliance.

6. The refrigerating appliance according claim 1, including said display divided into a plurality of fields, each field including a plurality of OLEDs and at least two of said fields differ in the emitted color spectra.

7. The refrigerating appliance according to claim 6, including each said field formed by a matrix of OLEDs.

8. A display, especially for a refrigerating appliance, comprising: a plurality of individual displays each including at least one organic light-emitting diode (OLED), said individual displays arranged one above another in a sandwich arrangement, wherein an uppermost one of said individual displays is configured for displaying arbitrary images, and wherein a lowermost one of said individual displays is configured for displaying background lighting.

9. The display according to claim 8, including OLEDs of various individual displays at least partially overlap when said display is viewed from above.

10. A refrigerating appliance, comprising:

a housing defining a refrigerated compartment;

a door attached to the housing and closing the refrigerated compartment; and a display secured to at least one of the housing and the door, wherein said display includes a plurality of organic light-emitting diodes (OLEDs) arranged in matrix form in columns and rows, and wherein the display comprises anodes in the form of electrode strips defining one of the columns and the rows with spacers therebetween, cathodes in the form of counter-electrode strips defining the other of the columns and the rows with spacers therebetween, an emission layer disposed between said anodes and said cathodes and spanning across all the columns and the rows of the plurality of OLEDs, and means for applying a voltage to the anodes and the cathodes to generate emitted light from selected portions of the display.

11. The refrigerating appliance according to claim 10, wherein each of the plurality of OLEDs forms a picture element of said display.

12. The refrigerating appliance according to claim 10, including said display forming a portion of a control panel of the refrigerating appliance.

13. The refrigerating appliance according to claim 10, including said display arranged in the refrigerated compartment of the refrigerating appliance.

14. The refrigerating appliance according claim 10, including said display divided into a plurality of fields, each field including a plurality of OLEDs and at least two of said fields differ in the emitted color spectra.

15. The refrigerating appliance according to claim 14, including each said field formed by a matrix of OLEDs.

* * * * *